United States Patent [19]

Lindblad et al.

[11] 4,292,924

[45] Oct. 6, 1981

[54] MAGNETIC BRUSH APPARATUS

[75] Inventors: Nero R. Lindblad, Palmyra; Ivan Rezanka, Pittsford; John V. Cassidy, Rochester, all of N.Y.

[73] Assignee: Xerox Corporation, Stamford, Conn.

[21] Appl. No.: 81,411

[22] Filed: Oct. 3, 1979

[51] Int. Cl.[3] ..... G03G 15/09
[52] U.S. Cl. ..... 118/658
[58] Field of Search ..... 118/657, 658

[56] References Cited

U.S. PATENT DOCUMENTS 3,915,121 10/1975 Wilcox ..... 118/637
3,939,801 2/1976 Tanaka et al. ..... 118/658

*Primary Examiner*—Bernard D. Pianalto

[57] ABSTRACT

A magnetic brush apparatus which minimizes the escape of toner and/or carrier particles by means of a magnetic field shaping device which minimizes the presence of magnetic lines of force projecting axially outward from the magnetic brush rollers. Examples of magnetic field shaping devices are a piece of ferro-magnetic material and a magnetic field shaping magnet.

9 Claims, 6 Drawing Figures

MAGNETIC BRUSH APPARATUS

BACKGROUND OF THE INVENTION

This invention relates to electrostatographic copying machines and, more particularly, to an improved magnetic brush apparatus for use in electrostatographic copying machines.

In the practice of xerography as described in U.S. Pat. No. 2,297,691 to Chester F. Carlson, a xerographic surface comprising a layer of photoconductive insulating material on a conductive backing is used to support electrostatic images. In the usual method of carrying out the process, the xerographic plate is electrostatically charged uniformly over its surface, and then exposed to a light pattern of the image being reproduced to thereby discharge the charge in the areas where light strikes the layer. The undischarged areas of the layer thus form an electrostatic charge pattern or latent electrostatic image in conformity with the configuration of the original pattern.

The latent electrostatic image is developed by contacting it with a finely divided electrostatically attractable material, such as a resinous powder. The powder is held in the image areas by the electrostatic fields on the layer. Where the field is greatest, the greatest amount of material is deposited, and where the field is least, little or no material is deposited. Thus, a powder image is produced in conformity with the image of the original being reproduced. The powder image is subsequently transferred to a sheet of paper or other transfer member, and suitably affixed thereto to form a permanent copy.

After the powder image is transferred, some residual toner usually remains on the imaging surface. The removal of all or substantially all of such residual toner is important to high copy quality since unremoved toner may appear as the background in the next copying cycle. The removal of the residual toner remaining on the imaging surface after the transfer operation is carried out in a cleaning operation.

In present day commercial automatic copying and duplicating machines, the electrostatographic imaging surface, which may be in the form of a drum or belt, moves at high rates in timed unison relative to a plurality of processing stations around the drum or belt. This rapid movement of the electrostatographic imaging surface has required vast amounts of toner to be used during development period. Thus, to produce high quality copies, a very efficient development apparatus and background removal apparatus or cleaning apparatus are necessary. Conventional cleaning devices have not been entirely satisfactory in this respect. Most of the known cleaning devices usually become less efficient as they become contaminated with toner, which cannot be removed, thus necessitating frequent replacement of the cleaning device. As a result, valuable time is lost during "down time" while a change is being made. Also, the cost of the cleaning device increases the per copy cost in such an apparatus. Other disadvantages with the conventional "web" type or the "brush" type cleaning apparatus are known to the art. Similarly, deficiencies of conventional development apparatus also are known. Thus, there is a need for improved development and/or cleaning apparatuses.

PRIOR ART STATEMENT

A number of patents disclose the so called magnetic brush cleaning system. See, e.g., U.S. Pat. Nos. 2,911,330, 3,580,673, 3,700,328, 3,713,736, 3,918,808, 4,006,987, 4,116,555 and 4,127,327. Briefly, in each of these patents there is disclosed a magnetic brush cleaning system in which a magnetic roller is mounted for rotation and located adjacent to the area of the photoreceptor surface to be cleaned. A quantity of magnetic carrier beads or particles are in contact with the magnetic roller and are formed into streamers or brush configuration. The magnetic roller supporting the brush may be connected to a source of DC potential to exert electrostatic attraction on the residual toner image to be cleaned. Thus, the magnetic brush removes toner from the imaging surface by mechanical, electrostatic as well as triboelectric forces.

In the magnetic brush cleaning devices of the prior art, it is a general practice to fixedly mount one or more permanent magnets inside of a roller which is itself mounted for rotation. See, e.g., U.S. Pat. Nos. 3,580,673, 3,713,736, and 4,006,987. In such a structure, toner particles or carrier and toner particles are attracted to the exterior surface of the roller and there form bristles or streamers. Due to the presence of magnetic field and the direction of the magnetic lines of force, such bristles are formed not only in the central portions of the roller, but they are also present in the regions near the ends of the roller. Moreover, in the prior art magnetic brush cleaning apparatus, some bristles are formed at the ends of the roller. During the operation of the magnetic brush cleaning apparatus, the magnets are stationary while the roller is rotated, thus resulting in relative motion between those two components of the cleaning apparatus. This relative motion in turn, causes the bristles on the surface of the roller to be continually made to "stand up" and collapse onto the surface of the roller. When the roller is rotated at a relatively high speed, some toner particles or toner and carrier particles at the ends of the bristles may be slung out as a result of their travel through a stationary magnetic field. The escape of such particles, over a period of time, is believed to be a cause of malfunction in other parts of the copying and duplicating machine. Accordingly, there is a need for improved magnetic brush cleaning apparatus.

The escape of toner particles or carrier and toner particles from the ends of magnetic brush cleaning roller, described above, occurs also with magnetic brush development mechanisms of the prior art. Magnetic brush developers are well known in the art. See, e.g., U.S. Pat. Nos. 3,916,830, 3,927,641, 3,929,098, and 3,981,272. Broadly, magnetic brush developers differ from magnetic brush cleaners in the desired direction of travel of the toner or marking material: in the developer, the toner is applied onto the latent image on the photoconductive insulating surface; in the cleaner, the excess marking material is removed from the photoconductive insulating surface.

It is, therefore, an object of the present invention to provide a novel magnetic brush apparatus which provides efficient operation during long periods of time between service calls. It is another object of the invention to provide a novel magnetic brush apparatus which minimizes the escape of toner particles or toner and carrier particles from the apparatus to other areas in the copying and duplicating machine. These and other objects of the invention will be apparent from the following disclosure.

SUMMARY OF THE INVENTION

In accordance with the present invention, a magnetic brush apparatus is provided which prevents the escape of toner particles or toner and carrier particles from the apparatus to the remaining areas of the copying and duplicating machine by minimizing the formation of bristles or streamers at the ends of the magnetic brush roller. The formation of bristles at the ends of the magnetic brush roller is minimized by means of magnetic field shaping device which prevents or minimizes the presence of magnetic lines of force which project axially outward from the magnetic brush roller. Examples of magnetic field shaping devices are a piece of a ferromagnetic material and a magnetic field shaping magnet.

DETAILED DESCRIPTION OF THE INVENTION

Figure 1:
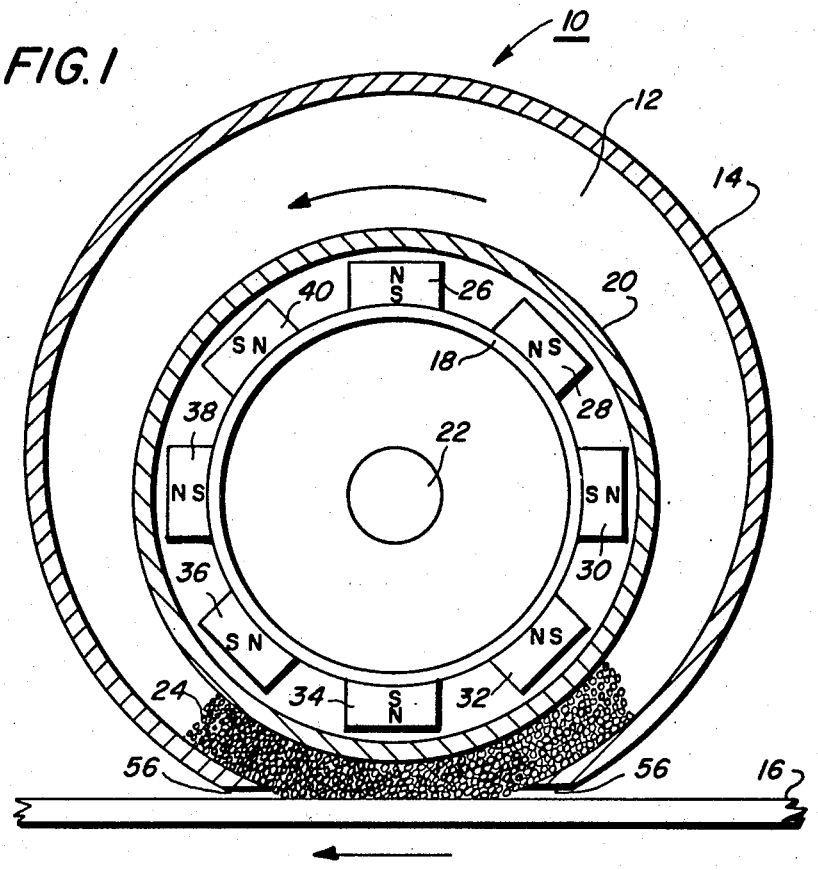
FIG. 1 shows a partial cross-sectional view of a magnetic brush apparatus of the type used in xerographic cleaning devices.

Referring to the drawings, in FIG. 1, a magnetic brush apparatus 10 commonly used in xerographic cleaning operations is shown in a partial cross-sectional view. Other parts of the cleaning device, known in the art, are not shown. It is to be understood that although the drawings and the following description are directed to a cleaning device, the invention is equally applicable to magnetic brush development mechanisms. The magnetic brush apparatus 10 is made of a brush roll 12 and a housing 14. In this illustration, the magnetic brush apparatus 10 is shown to be located on top of a photoconductive insulating surface 16, and the brush roll 12 is rotated in a counter clock-wise direction while the photoconductive insulating surface 16 moves from left to right, thus resulting in a counter-current type of relative motion at the points of their contact. However, such an arrangement is not critical and they are shown for illustrative purposes only.

The brush roll 12 is made of an inner sleeve or support 18 and an outer shell or roller 24. The outer shell or roller 20 is rotatably mounted on a shaft 22. On the exterior surface of the outer shell or roller 20, brush bristles or streamers 24 are formed of carrier particles, in the form of beads or powder and/or toner particles.

The inner sleeve or support 18, which may conveniently be made of such ferro-magnetic materials as cold rolled steel, is fixedly mounted and normally does not rotate with the outer shell or roller 20. A number of magnets 26, 28, 30, 32, 34, 36, 38, and 40 are fixedly mounted on the outer surface of the inner sleeve or support 18. These magnets may be permanent magnets or electromagnets. As is understood by those skilled in this art, the pole faces of the magnets should be positioned so as to result in alternating polarity between neighboring magnets. For example, in FIG. 1, the pole face or the side of magnet 34 facing the outer shell 20 is north and the side of magnet 34 facing the inner sleeve 18 is south. The number of magnets mounted on the outside of sleeve 18 may be varied, depending on the particular application for the magnetic brush apparatus. Although the magnets are shown to be separate magnets mounted on the outside of sleeve 18, it will be appreciated that a single magnetizable piece of material, sections of which may be separately magnetized, may be used. However, the magnet 34 is usually a separate magnet from the others, and it may be a stronger magnet such as one or more ceramic magnets. The entire inner sleeve structure is mounted so as to be stationary during the operation of the magnetic brush apparatus.

Figure 2:
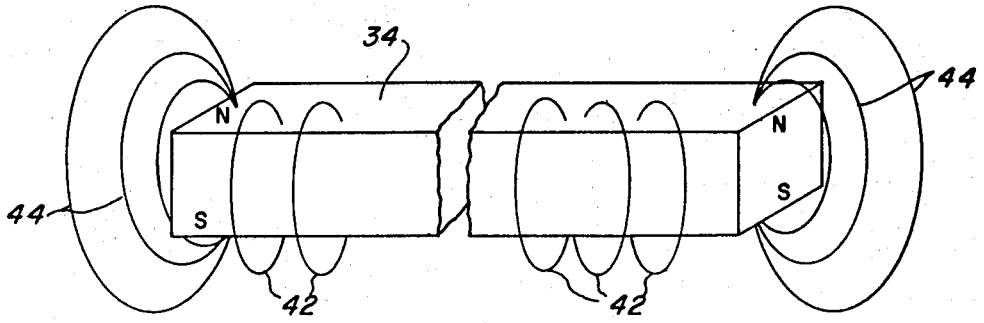
FIG. 2 illustrates some of the magnetic lines of force around one of the magnets in the magnetic brush apparatus of FIG. 1.

In FIG. 2, one of the magnets mounted on the inner sleeve or support 18, for example magnet 34, is shown in its lengthwise direction or the axial direction of the shaft 22. Magnet 34 is in the shape of an elongated bar and for purposes of illustration, its north pole face is shown as the top surface and the south pole face is the bottom surface. As can be seen from the drawing, the primary magnetic field generated by magnet 34 is represented by the magnetic lines of force 42. At the ends of magnet 34, a fringe field is present and this is illustrated by the lines of force 44. In this fringe field, as in the primary magnetic field represented by the lines of force 42, bristles will form on the outer shell 20 in conformity with the field or lines of force 44. Bristles in the shape of lines of force 44 formed on the outer shell 20, when the outer shell 20 is rotated around the shaft 22, will ultimately collapse and be reformed as the particular spot on the outer shell 20 travels through the various magnetic fields associated with the several magnets. When the outer shell 20 is rotated relatively rapidly, this has the effect of producing a force on the particles forming the bristles in the shape of lines of force 44 and sometimes causes some of the particles to be slung in an outward direction, away from the brush roll 12. Although most of such escaping particles are contained by the housing 14, some of these particles will escape from the magnetic brush apparatus, particularly at the opening or clearance 56 (see FIG. 1) between the housing 14 and the photoconductive insulating surface 16. Such escaping particles tend to contaminate other parts of the copying machine and they are believed to be a contributing cause to malfunctions and the need for servicing.

Figure 3:
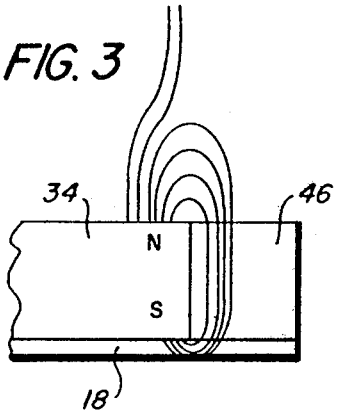
FIG. 3 shows one embodiment of the magnetic brush apparatus of the present invention, with some magnetic lines of force illustrated.

In accordance with the present invention, a magnetic field shaping device is provided at the end of the main magnets mounted on the inner sleeve 18, particularly those magnets near the opening 56. The simplest form such a magnetic field shaping device may take is a piece of a ferro-magnetic material placed adjacent the end of the main magnet. This embodiment is shown in FIG. 3, where the piece of ferro-magnetic material 46 acts as a shunt for the magnetic lines of force from the end of main magnet 34 to minimize or eliminate the fringe field lines in the axial direction of the shaft 22.

Figure 4:
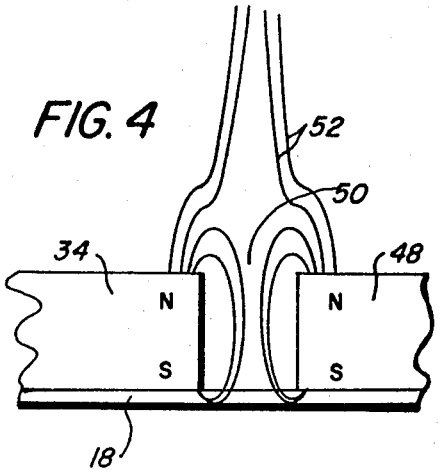
FIG. 4 shows another embodiment of the magnetic brush apparatus of the invention.

In the embodiment shown in FIG. 4, a field shaping magnet 48 is shown and separated from the main magnet 34 by an air gap 50. When the field shaping magnet 48 is so placed that its polarity is the same as that of the main magnet 34, the magnetic lines of force from the two magnets will tend to repel each other and cause them to "stand up", which is in the radial direction to the shaft 22, rather than in the direction of lines of force 44, which is in the axial direction of the shaft 22. The alternate formation and collapse of bristles in the shape of standing lines of force 52 will not cause the loss of particles from the magnetic brush apparatus 10 to the same extent as bristles in the shape of lines of force 44. The embodiments shown in FIGS. 3 and 4, though simpler than those illustrated in FIGS. 5 and 6 to be described below, are not as effective and thus not preferred. However, the effectiveness of the embodiment of FIG. 4 can be increased by substituting a piece of ferro-magnetic material for the air gap 50.

Figure 5:
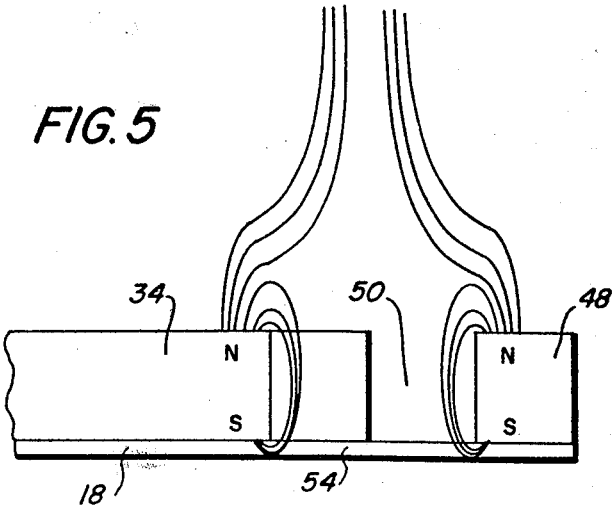
FIG. 5 illustrates another and a preferred embodiment of the magnetic brush apparatus of the invention.

FIG. 5 illustrates one preferred embodiment of the present invention. Here, a piece of ferro-magnetic material 54 is placed at the end of the main magnet 34 adjacent the air gap 50. The purpose of the ferro-magnetic material 54 is to lessen any tendency on the part of the field shaping magnet 48 to attract particles from the main magnet 34. An alternative configuration for this embodiment is to have the ferro-magnetic material 54 at the end of the field shaping magnet 48, and position the air gap 50 between the ferro-magnetic material 54 and the main magnet 34.

Figure 6:
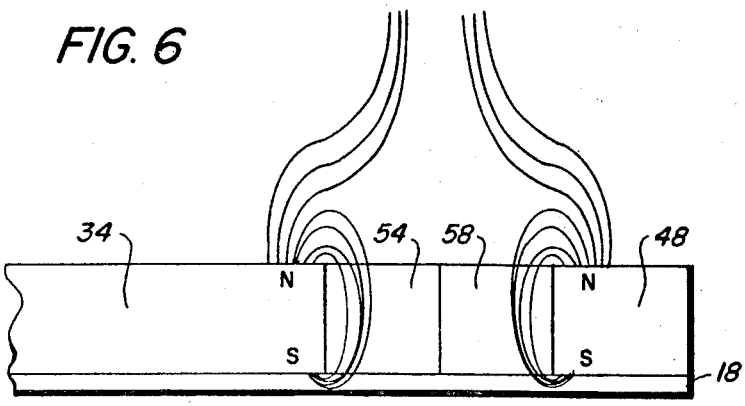
FIG. 6 shows a further and a preferred embodiment of the magnetic brush apparatus of the present invention.

FIG. 6 illustrates another preferred embodiment of the present invention. In this embodiment, the air gap 50 of FIG. 5 has been replaced by a piece of a nonferro-magnetic material 58. Examples of nonferro-magnetic material which can be used for this purpose are paper and nonmagnetic plastics. The presence of the piece of nonferro-magnetic material 58 facilitates the accurate spacings of the other parts, particularly since strong magnetic fields are present. As in the case of the embodiment of FIG. 5, the positions of the piece of nonferro-magnetic material 58 and the piece of ferro-magnetic material 54 can be exchanged with good results.

The amount of the air gap or the thickness of the ferro-magnetic material 54 or the nonferro-magnetic material 58 to be used depends, inter alia, on the strength of the magnetic field present. For example, when several hundred to over a thousand gauss are present on the surface of the outer shell 20, we have found an air gap of about $\frac{1}{8}''$ to be appropriate. Under similar magnetic field strength, in the embodiment shown in FIG. 6, we have used cold rolled steel 0.08" thick as the ferro-magnetic material 54, and common plastic also 0.08" thick with good results. Generally, we prefer to use a total spacing between the ends of the main magnet and the field shaping magnet in the order of $\frac{1}{8}$ inch to about $\frac{1}{4}$ inch, although somewhat more or less spacings may be used depending on the particular construction of the magnetic brush apparatus.

Although the foregoing detailed description has been with reference to the main magnet 34 in the magnetic brush apparatus of FIG. 1, the magnetic field shaping devices of the present invention can be advantageously used with all of the main magnets in the development or cleaning zone. Again referring to the magnetic brush apparatus of FIG. 1, main magnets 32, 34 and 36 are generally considered to be within the cleaning zone. Surprisingly, we have found that the use of the magnetic field shaping devices of the present invention can reduce the loss of particles from the magnetic brush apparatus by a factor of 100 or more.

While the invention has been described in detail with reference to specific and preferred embodiments, it will be appreciated that various modifications may be made from the specific details without departing from the spirit and scope of the invention.

What is claimed is:

1. A magnetic brush apparatus for use in an electrostatographic printing machine, including:

a tubular member journaled for rotation about the longitudinal axis thereof;

a magnetic member mounted stationarily and interiorly of said tubular member, said magnetic member generating a radial magnetic field extending outwardly therefrom in a direction substantially normal to the longitudinal axis of said tubular member and an axial magnetic field extending outwardly from opposed ends of said magnetic member in a direction substantially parallel to the longitudinal axis of said tubular member; and means, positioned radially interiorly of said tubular member in the region of opposed ends of said magnetic member and cooperating therewith, for substantially suppressing the axial magnetic field.

2. A magnetic brush apparatus of claim 1, wherein said magnetic member includes a plurality of permanent magnets.

3. A magnetic brush apparatus of claims 2 or 1 wherein said suppressing means includes a ferro-magnetic member disposed in the region of the end of said magnetic member.

4. A magnetic brush apparatus of claim 3 wherein said ferro-magnetic member is cold rolled steel.

5. A magnetic brush apparatus of claims 2 or 11, wherein said suppressing means includes a suppression magnet spaced from the end of said magnetic member and having the polarity of the magnetic poles thereof arranged in the same direction as the polarity of the magnetic poles of said magnetic member.

6. A magnetic brush apparatus of claim 5 wherein said suppression magnet is axially spaced from the end of said magnetic member by a ferro-magnetic member.

7. A magnetic brush apparatus of claim 5 wherein said suppression magnet is axially spaced from the end of said magnet member by an air gap and a ferro-magnetic member.

8. A magnetic brush apparatus of claim 5 wherein said suppression magnet is axially spaced from the end of said magnetic member by a non-magnetizeable member and a ferro-magnetic member.

9. A magnetic brush apparatus of claim 8 wherein said non-magnetizeable member is paper or a plastic.

* * * * *